US006705919B2

(12) United States Patent
Curran et al.

(10) Patent No.: US 6,705,919 B2
(45) Date of Patent: Mar. 16, 2004

(54) ELECTRONIC AMUSEMENT DEVICE WITH LONG DURATION TIMER

(75) Inventors: Kevin G. Curran, Upper Saddle River, NJ (US); Charles R. Mahoney, Maplewood, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/041,712

(22) Filed: Jan. 8, 2002

(65) Prior Publication Data

US 2003/0129922 A1 Jul. 10, 2003

(51) Int. Cl.[7] ..... A63H 29/22

(52) U.S. Cl. ..... 446/484; 446/175; 446/268; 446/369; 368/108; 368/45

(58) Field of Search ..... 446/175, 297, 446/298, 299, 300, 301, 302, 303, 268, 369, 484; 368/45, 107, 108, 109, 110, 111, 112, 113, 10, 12; 340/384.7, 384.71

(56) References Cited

U.S. PATENT DOCUMENTS

| | | | | | |
|---|---|---|---|---|---|
| 4,253,175 | A | * | 2/1981 | Masuda et al. | 368/85 |
| 4,742,500 | A | * | 5/1988 | Luce | 446/369 |
| 5,172,806 | A | * | 12/1992 | Mickelberg | 206/459.5 |
| 5,283,567 | A | * | 2/1994 | Howes | 206/457 |
| 5,411,138 | A | * | 5/1995 | Klawiter | 206/459.1 |
| 5,684,758 | A | * | 11/1997 | Gray et al. | 446/369 |
| 5,718,335 | A | * | 2/1998 | Boudreaux | 206/461 |
| 5,795,209 | A | * | 8/1998 | Moore | 446/73 |
| 5,802,488 | A | * | 9/1998 | Edatsune | 704/231 |
| 5,966,526 | A | * | 10/1999 | Yokoi | 703/11 |
| 5,992,629 | A | * | 11/1999 | Gullord et al. | 206/459.1 |
| 6,167,362 | A | * | 12/2000 | Brown et al. | 703/11 |
| 6,188,311 | B1 | * | 2/2001 | Rothschild | 368/108 |
| 6,227,931 | B1 | * | 5/2001 | Shackelford | 446/484 |
| 6,251,010 | B1 | * | 6/2001 | Tajiri et al. | 463/43 |
| 6,273,815 | B1 | * | 8/2001 | Stuckman et al. | 463/9 |
| 6,319,087 | B1 | * | 11/2001 | Ferrigno | 446/297 |
| 6,443,796 | B1 | * | 9/2002 | Shackelford | 446/484 |
| 6,449,518 | B1 | * | 9/2002 | Yokoo et al. | 700/86 |
| 6,567,344 | B1 | * | 5/2003 | Auer | 368/21 |
| 2002/0009018 | A1 | * | 1/2002 | Patella | 368/108 |

FOREIGN PATENT DOCUMENTS

| | | | | |
|---|---|---|---|---|
| EP | 712074 | A2 * | 5/1996 | G06F/9/44 |
| EP | 860789 | A1 * | 8/1998 | G06F/19/00 |
| JP | 2002172274 | A * | 6/2002 | A63H/3/02 |

OTHER PUBLICATIONS

CYBERLIFE, Mindscape Entertainment, http:creatures-.mindscape.com, 1996.*

Catalog entitled "Toy Fair 2001", Fisher–Price® Character Brands, New York, NY, cover and pp. 62–63.

* cited by examiner

*Primary Examiner*—Derris H. Banks
*Assistant Examiner*—Urszula M Cegielnik
(74) *Attorney, Agent, or Firm*—Akin Gump Strauss Hauer & Feld, LLP

(57) ABSTRACT

An electronic amusement device includes a housing having an outer side presented to a consumer using the device; an electronic timer in the housing and a controller. The timer is configured to track time to an end of an extended time period having a length of at least a plurality of weeks and preset in the device before the device is released to the consumer. The timer is further configured to output a signal at the end of the extended period to the controller. The controller is configured to perform at least one task in an initial mode of operation available to the consumer using the device and to respond to the signal from the timer to enable, for a first time, the performance of at least one new additional mode of operation the controller did not perform before receipt of the timer signal or to disable a mode of operation it had performed or to exchange a new mode of operation for a previously performed mode of operation.

20 Claims, 4 Drawing Sheets

ELECTRONIC AMUSEMENT DEVICE WITH LONG DURATION TIMER

BACKGROUND OF THE INVENTION

Toy makers have taken advantage of the falling costs of electronic processors and memory and increasingly sophisticated sound generators utilizing programmable microcontrollers that can further be used to control other operations as well as play patterns of a toy or other amusement device. In addition, one or more user inputs can be provided in the form of switches, buttons, sensors or the like which are coupled to the microcontroller. The microcontroller responds to such inputs in accordance with how it is programmed. The microcontroller may play back sounds of various kinds, including music, speech and/or sound effects, through loud speakers or other transducers or may control sources of light, movement and so on.

The types of microcontrollers currently used in toys vary in complexity from simple, state-machine based 4-bit controllers to R.I.S.C. based 16-bit microprocessor. The choice of microcontrollers is based on many factors including costs, performance and availability.

Some devices have microcontrollers which are programmable by the ultimate user. These include, for example, U.S. Pat. Nos. 5,697,829, 5,656,907, 5,908,345 and 6,083,104. These devices either require access to an outside computer, e.g over the Internet, to download new programming or require the end user to reprogram the device itself using a PC or other separate computer. This does, however, have the benefit of allowing play patterns and/or modes of operation of the device to be changed so that the devices remain fresh and entertaining. It is believed that it would be very desirable to provide the ability to change the operation(s)/play pattern(s) of an amusement device automatically so that the user does not have to have access to the Internet, an outside processor or the like. It is further believed that having an inherent capability to change in the device would provide a very valuable capability beyond the mere change of modes of operation and play and/or play patterns. By mode of operation, reference is being made to one or more tasks provided by a controller of the device in simultaneously or in a sequence in a prescribed order. Tasks are any discrete operation performed by the device including but not limited to the recognition of user inputs and the activation of one or more sources of action, i.e. sound, light and/or movement. A play mode or play pattern is a set or collection of related mode(s) of operation, which define how the device operates or interacts with the user.

BRIEF SUMMARY OF THE INVENTION

In one aspect, the invention is an electronic amusement device comprising: a housing having an outer side presented to a consumer using the device; an electronic timer in the housing configured to track time to an end of an extended time period having a length of at least a plurality of weeks and preset in the device before the device is released to the consumer, the timer further being configured to output a signal at the end of the extended period; and a controller in the housing configured to perform at least one task in at least an initial mode of operation available to the consumer using the device, the controller being operably coupled with the timer and responsive to the signal from the timer to enable, for a first time, performance of at least one new additional task the controller did not perform before receipt of the timer signal.

In another aspect, the invention is an electronic amusement device comprising: a housing having an outer side presented to a consumer using the device; a controller in the housing configured to provide at least one initial mode of operation of at least part of the device for the consumer; and an electronic timer in the housing operably coupled with the controller, the timer being configured to track time to an end of an extended time period, the period being of a length of at least a plurality of weeks and preset in the device before the device is released to the consumer, the timer further being configured to output a signal to the controller at the end of the extended period; wherein the controller is configured to respond to the signal from the timer to provide for a first time, a new mode of operation different from all of the initial modes of operation provided by the controller before receipt of the timer signal by the controller.

In yet another aspect, the invention is an electronic amusement device comprising: a housing having an outer side presented to a consumer using the device; a controller in the housing configured to provide at least one initial mode of operation of at least part of the device for the consumer; and an electronic timer in the housing operably coupled with the controller, the timer being configured to track time to an end of an extended time period, the period being of a length of at least a plurality of weeks and preset in the device before the device is released to the consumer, the timer further being configured to output a signal to the controller at the end of the extended period; wherein the controller is configured to respond to the signal from the timer to disable for a first time, at least one of the initial modes of operation provided by the controller before receipt of the timer signal by the controller.

In yet another aspect, the invention is an electronic amusement device comprising: a housing having an outer side presented to a consumer using the device; a controller in the housing configured to provide at least one initial mode of operation of at least part of the device for the consumer; and an electronic timer in the housing operably coupled with the controller, the timer being configured to track time to an end of an extended time period, the period being of a length of at least a plurality of weeks and preset in the device before the device is released to the consumer, the timer further being configured to output a signal to the controller at the end of the extended period; wherein the controller is configured to respond to the signal from the timer to change for a first time, the one initial mode of operation provided by the controller before receipt of the timer signal by the controller to a different mode of operation.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
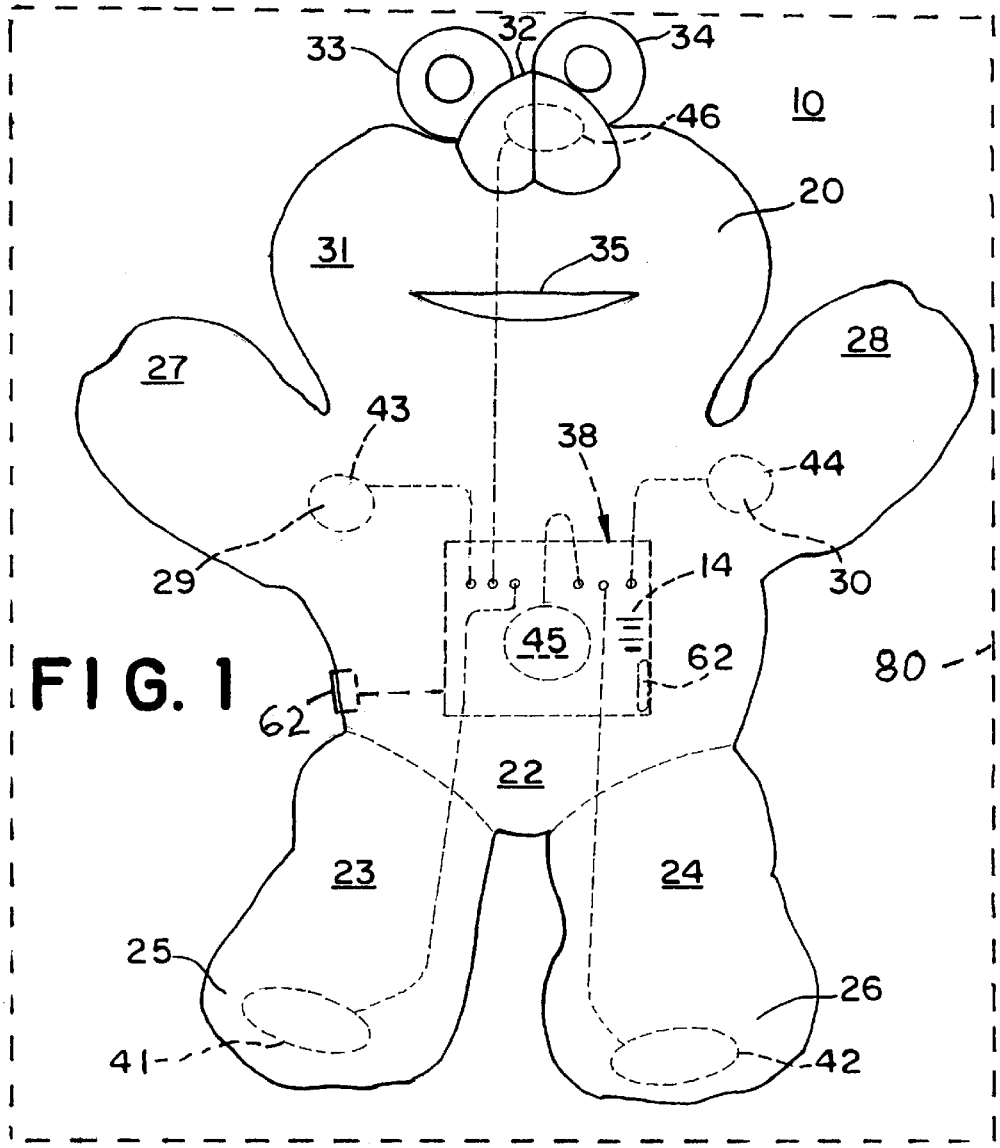
FIG. 1 is a diagrammatic, front view of an electronic amusement device of the present invention.

FIG. 1 depicts a first exemplary embodiment of the invention, an electronic amusement device in the form of a doll indicated generally at 10. Device 10 has a "plush" or soft fabric body indicated generally at 20, which is an outer housing of the device 10. That is to say, body 20 has an outer side, approximately half of which is depicted in FIG. 1, which is presented to a consumer using the device 10. The fabric body/outer housing 20 is maintained in three dimensional condition with internal stuffing or batting in a conventional matter for plush toy dolls. The doll 10 has a torso 22, legs 23, 24 with feet 25, 26, respectively, arms 27, 28 with armpits 29, 30, respectively and a head 31 with nose 32, eyes 33, 34 and mouth opening 35, respectively. The device 10 includes a plurality of user input devices 41–46, preferably in the form of momentary contact switches, which are located in various places in the housing/fabric body 20 of the device, for example, the feet 25, 26, armpits 29, 30, tummy (lower front central area of the torso 22) and nose 32. Device 10 further includes several other electrical, electronic and electro-mechanical components to be described, which are located together in a protective inner housing indicated in phantom at 38, which is generally not presented or visible to a consumer using the device. Inner housing 36 is preferably located within the housing/fabric body 20 and generally rigid in comparison to the outer housing/plush body 20 but is surrounded by the internal batting. Input devices/switches 41–46 are all operably, (at least electrically) coupled with a controller to be described that is preferably located in the inner housing 38. A seventh switch 47 may be provided to permit a TRY-ME mode of the device in its package. Such a capability is disclosed in U.S. Pat. No. 6,319,087B1 issued Nov. 20, 2001 and incorporated in its entirety by reference.

Figure 2:
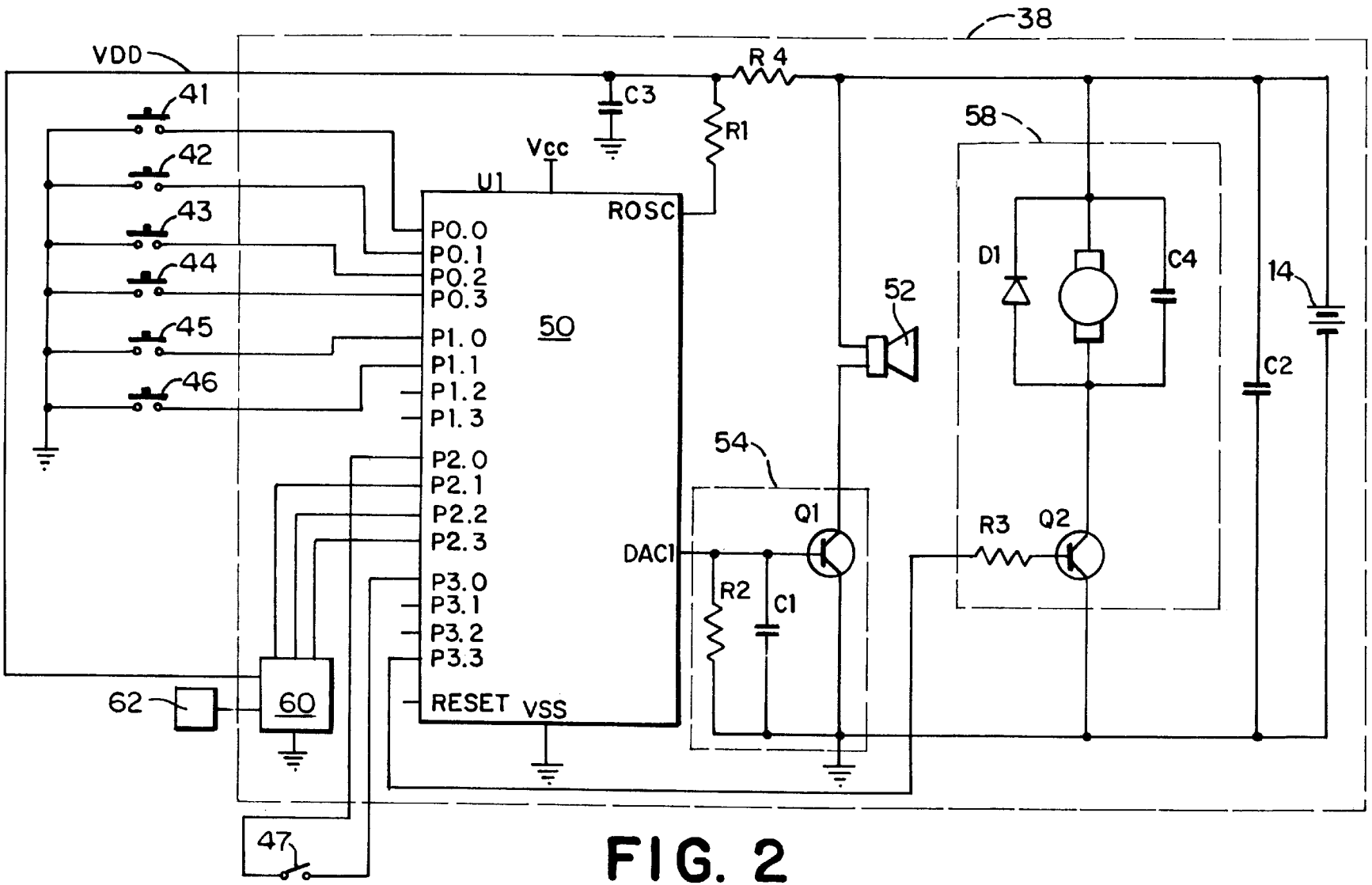
FIG. 2 is a schematic diagram of the electronic and electromechanical components of the device of FIG. 1.

The other internal electrical, electronic and electromechanical components of the device 10 are indicated in schematic diagram presented as FIG. 2. Devices of the invention generally include a controller operably coupled with one or more source(s) of sound, light and/or movement of the amusement device. This output or these outputs provide the amusement aspect of the electronic amusement devices of the present invention. In this example 10 of the present invention, the controller is preferably in the form of an integrated electronic programmable microcontroller or microprocessor indicated at 50. Microprocessor 50 preferably includes a CPU, electronic data storage including an operating program, software and/or hardware sufficient to synthesize sounds and other software and hardware to control the operation of a variety of output devices within amusement device 10. Controller/processor 50 is operatively (at least electrically) coupled with each of the user input devices 41–46 (or 47) identified above (momentary contact switches in various parts of the doll's body 20). In device 10, controller/processor 50 is operatively (at least electrically) coupled with a source of sound in the form of a speaker 52 through an electronic switch 53 in a drive circuit indicated generally at 54. The controller/processor 50 is also operatively coupled (at least electrically) with a source of movement in the form of an internal electric motor 56 through an electronic switch 57 in a motor drive circuit indicated generally at 58. Although device 10 does not include any, controller/processor 50 could also be connected with a source or sources of light (e.g. light bulb(s), diode, LCD or other types of visual displays, lasers, etc.) to control their operation(s) as well. Motor 56 is configured to cause movement to some part of the device 10. In particular, motor 56 rotates a shaft with an eccentrically positioned weight which causes the torso 22 of the doll 10 to shake or vibrate.

The device 10 further includes, operatively coupled to processor 50, to the speaker 52 and to the motor 58 as well as to the other circuit elements to be described, either directly or through the controller/processor 50, a power supply indicated generally at 14. In this case the power supply is provided by plurality of replaceable cells (e.g. 3 AA batteries), but other batteries sizes and types (e.g. rechargeable) as well as other electrical power supplies (e.g. ac wall supplies or transformers) can be used in or with the devices of the present invention.

According to a most important aspect of the present invention, devices such as device 10 include an electronic timer, in particular, a relatively long duration timer operatively coupled with at least one controller in the device that is itself coupled with at least one source of sound, movement or light. Here timer 60 is operatively coupled with the electronic microcontroller/processor 50 that is operatively coupled with sources 52 and 56. Timers of the present invention including but not limited to timer 60 of device 10 are different from conventional timers in several respects. First, they are long duration timers. Timers of the present invention are configured to track time to the end of an extended time period having a length of at least a plurality of weeks, suggestedly for at least a month or a plurality of months and, if appropriate, even for one or a plurality of years. Secondly, the time period being tracked is preset in the timer before the device is released to the consumer. Timers of the present invention can be preset at the factory during manufacture but could be made to be preset by a distributor before release of the device to the consumer, i.e. the final purchaser or ultimate user. Timers of the present invention are configured to output a signal at the end of the extended period, suggestedly to the controller. In the simplest forms of the invention, a "controller" may be nothing more than a relay or a switch, the existing state of which would be changed by the signal output from the extended timer. Timers of the present invention can also be configured to output a signal at the end of each of two or more extended time periods tracked by the timer.

Figure 3:
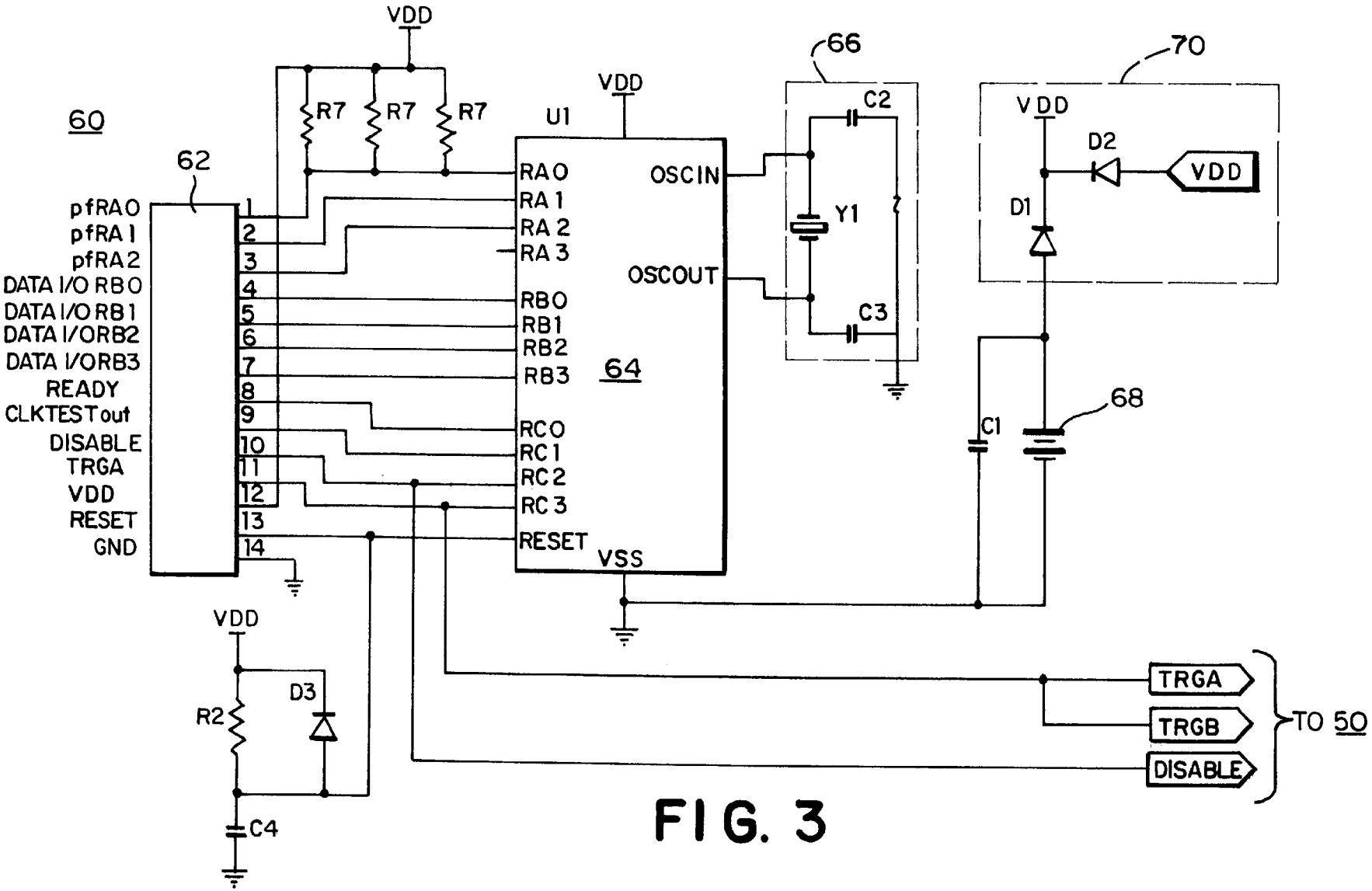
FIG. 3 is a schematic diagram of the electronic, long duration timer of FIG. 2.

FIG. 3 is a schematic of a timer for device 10 configured to track time for any desired period up to several years if an appropriate power supply is provided. Timer 60 includes a PC interface connector 62, a general purpose microprocessor 64, and a crystal oscillator 66. It further includes its own battery power supply 68 and, in this particular configuration, a switching circuit 70 enabling the timer 60 to be powered by either its own power supply 68 or the main power supply 14 of the device 10. Referring back to FIG. 1, the connector 62 can be extended outside the housing/fabric body 20 and the device 10 provided in a package (indicated in phantom at 80) suitably open in design like that disclosed in the aforesaid U.S. Pat. No. 6,319,087 so as to be accessible from outside the package without opening the package.

Microcontroller 64 is suggestedly a 4-bit, general purpose microprocessor with a programmable HOLD mode which will allow the timer 60 to operate in a very low current mode, thus saving battery life. This feature is an important consideration in a long duration timer, especially to minimize overall costs. A Winbond W741 series microcontroller is suggested as suitable for this use but any microcontroller having the requisite number of I/O ports, its own programmable timer and a HOLD or other low power operational mode could be used. Firmware that controls microcontroller 64 of timer 60 is attached at APPENDIX A. A fourteen pin/lead edge connector 62 provides all of the I/O needed to interface the timer 60 with a personal computer (PC) to program the timer 60. Seven I/O lines are used to store data into the microcontroller: ports RA0–RA2 are control flags and ports RB0–RB3 are actual data transfer lines. Data is entered into the microcontroller 64 in 4-bit-packs. The READY line is used to signal the PC that the microcontroller 62 us ready to accept data. The remaining lines are or can be used for diagnostics. This interface can also be used to read back programmed data to the programming PC for quality assurance. The interface can be exposed on the exterior of the inner housing as indicated in phantom in FIG. 1 so as to be programmed after the housing 38 is closed or even extended to the exterior of the device 10 so as to be exposed on or exposable from the plush outer housing 20. Crystal oscillator 66 provides a frequency source to the internal clock of the microcontroller 64. Timer 60 could be powered by the main battery power supply 14 of the device 10, but is suggestedly provided with its own exclusive power supply. In this case, power supply 68 is configured to act as a back-up power supply. Because of the low current draw of the system, a supply 68 of three button cell type batteries is all that are needed for a two-hundred and fifty day extended time period of operation. Switching circuit 70 is in the form of an OR circuit provided by a pair of identical diodes 72. Circuit 70 enables microcontroller 64 to be powered by main battery supply 14 if available and adequate but to switch to supply 68 should the main supply fail or be removed from the device 10.

Figure 4:
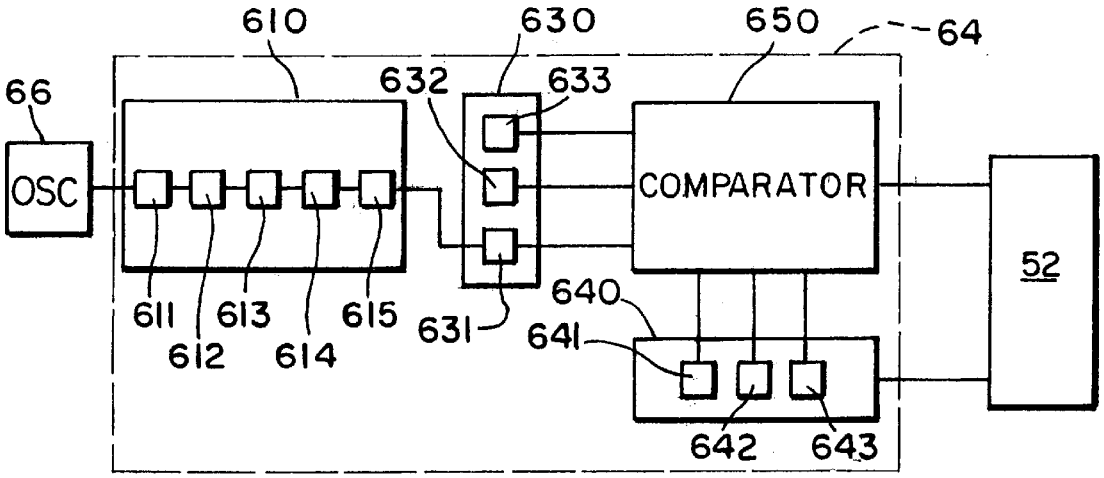
FIG. 4 is a schematic of a configuration of the microcontroller portion of the timer of FIG. 3.

A microcontroller chip such as a 4-bit Winbond W741C201, is suggestedly used as the main counter-timer. Referring to FIG. 4, the microcontroller 62 is configured to emulate a repeating timer/counter 610, a time period register 630 and a storage register 640 holding a day count length, e.g. xxx days. Repeating timer/counter 610 is provided by emulating five, 4-bit registers 611–615, which are serially connected so each register 611–614 increments the next register 612–615, respectively, when it cycles and which collectively divide the clock frequency provided by the oscillator 66 down to one cycle per day. Each register 611–614 of the counter 610 is allowed to count only as high as the four bits provided so a CARRY flag is not used. A once per day signal is output by the counter 610 and is used to increment the time period ("DAYCOUNT") register 630 each day. Register 630 is provided by emulating three, series connected, 4-bit registers to count the number of days passed. CARRY flags are used between these 4-bit registers. The value maintained in the time period/DAYCOUNT register 630 is compared to the predetermined/preprogrammed day count value stored in the storage register 640 (or elsewhere in RAM of the microcontroller 64) by a COMPARATOR 650 (or emulated comparison function). When the target date (end of the preprogrammed day count period) is reached, an output bit is set high to the microcontroller 52.

Referring to the firmware in Appendix A, the internal TIMER0 is set to divide the crystal oscillator frequency down to one pulse per 6-second interval (refer to the W741C20x data sheet). In order to avoid using the carry flag, each of the registers of the clock divider/repeating timer/counter 610 count only as high as 4 bits will allow. Thus, with a 6-second interval, it is only necessary to count to 10 (1010b) to determine that 1 minute (60 seconds) has passed. The counting scheme for the five emulated, serially connected 4-bit registers of the counter 610 is as follows:

Count 10 (1010b), six second intervals to log 1 minute

Count 15 minutes (1111b) for one Quarter Hour

Count 4 Quarter hours (0100b) for 1 hour

Count 12 hours (1100b) for one-half day

Count 2 (0010b) Half-days for 1 Full day

Each time two half-days are counted (equivalent to 1 full day), the first of the three DAYCOUNT registers (630) is incremented. This is the only time the carry flag (CF) is used. These registers are continually compared to the target setting stored in microcontroller 64 in a storage register 640 or in RAM and read into a register for comparison by a comparator function of the microcontroller 64.

Mathematically the day counting algorithm works this way:

6 seconds×10×15×4×12×2 86,400 seconds or 24 hours.

Figure 5:
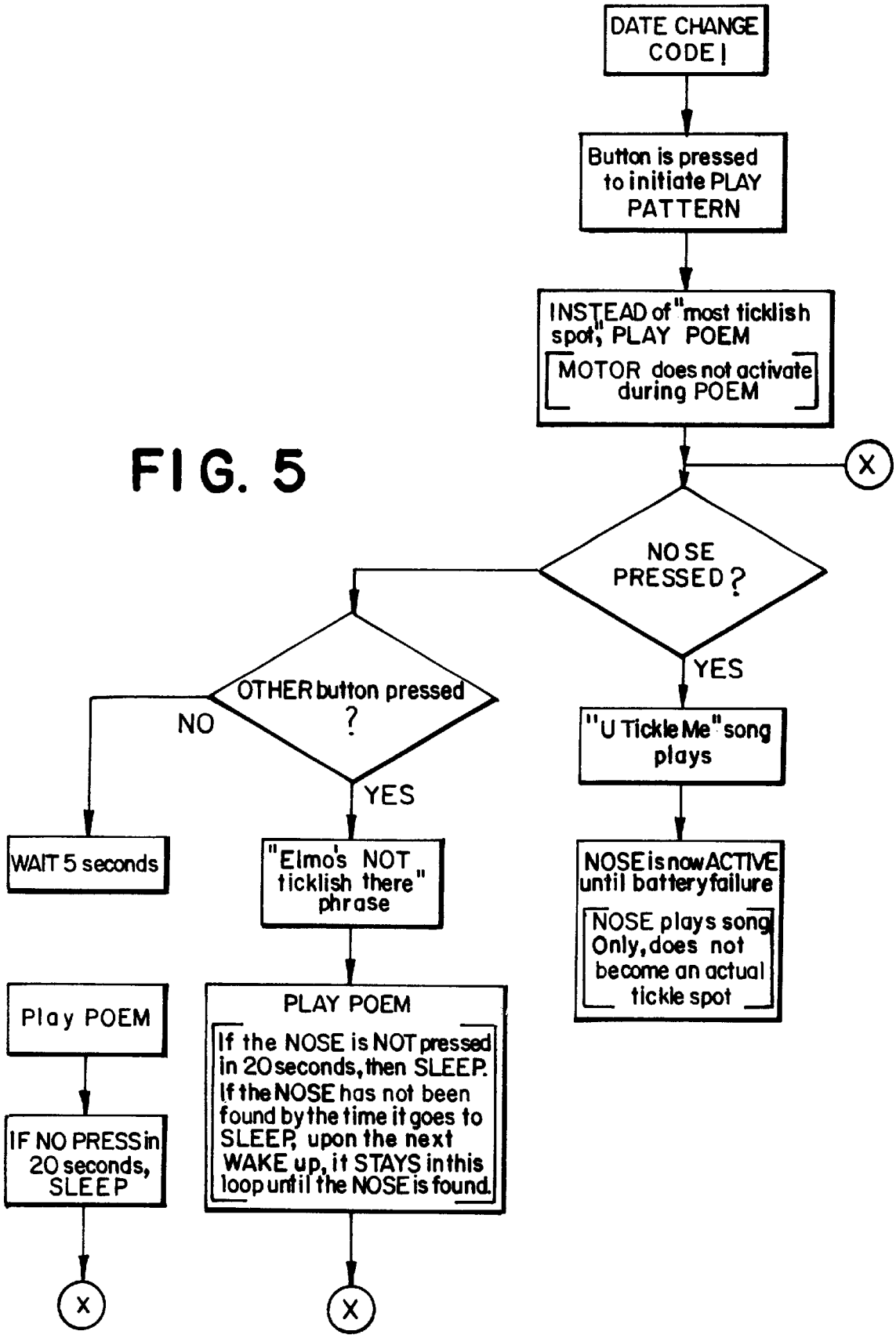
FIG. 5 is a flow chart of the new mode of operation enabled by the timer of FIGS. 3 and 4 in the device of FIG. 1.

The number of days for the time delay function is suggestedly downloaded into the RAM of the microcontroller 64 in three, 4-bit nibbles using the interface at 62. Thus the maximum number of days to delay is 1111 1111 111b or 0FFFH. This is equivalent to 4095 days. In practice the actual number of days programmed in device 10 was less than 250. Once the target number of days is reached a trigger signal is provided by the timer microcontroller 64 (U1 on schematic TMES1c) to controller/processor 50. The controller/processor 50 reads this input line, and due to its program, is configured to respond by enabling a new input switch 46 and a new speech pattern in response to the closure of the switch 46. For this application, five of the six user interface switches provided 41–45 are normally active. One switch, nose switch 46, becomes active at a predetermined date at the end of the targeted extended time period. This change in operating modes is reflected in FIG. 5. The microcontroller 50 responds to closure of each of the five initial switches 41–45 by generating a sound response. The microcontroller 50 further responds to tummy switch 45 closure by powering the motor 56 for a predetermined period of time to shake the device. At the end of the stored, predetermined time period, the microcontroller 50 will respond to closure of switch 46 with the generation of a poem or other sound bite. Before the end of the present extended time period, microcontroller 50 is not responsive to closures of switch 46 and does not output the poem or other sound bite that is finally outputted.

The design can have other variations. A single speech-processing microcontroller can be used, provided that it has a programmable timer and a low-power mode to reduce battery drain while the timer is running. Various input devices other than momentary contact switches and push-buttons could be interfaced to the microcontroller (e.g. sensors, transducers, controls, etc.) to provide user interaction. Other output devices could be controlled (e.g. lights, visual display units, etc.) or none could be used. Battery 68 back-up may not be required. The programming interface 62 may not be needed if a remote PC is not used. Timer programming may take any of the following forms or other forms. (a) Single button start control—the user effectively resets the counting function to start from zero. The timer counts to the present time value and then causes a change in the play pattern. (b) The user enters actual time and date information so that the timer function is synchronized to real-time events such as time of day, or other special timed events such as television shows. (c) Auto-start in production so that timer function begins immediately and does not require any user interaction. The play pattern change can take place hourly, daily, monthly or yearly or any other increment of time desired. The play pattern change could be continuous (changes every day/week/month/etc.) or may only occur once or a limited number of times after the timer is initially started. The timer circuit could be used in a plush item (either mechanized or not) or in virtually any other amusement device of sufficient size such as but not limited to a hand-held game or toy, or in a toy vehicle, or any other toy.

As can be seen, the timer 60 of the present invention enables amusement device 10 to add at least one new mode of operation after a predetermined time period programmed into the timer during manufacture. Furthermore, the specific configuration of timer 60 enables the time period programmed to be changed for each device 10. This enables the devices 10 to be programmed to add modes at the same time, that is at least on the same day or within a twenty four hour period. This enables even more modes of operation. The amusement devices of the present invention can be programmed to activate or change modes on specific calendar days thus enabling them to be tied into marketing plans, for example, the premier of a movie or the date of another entertainment event. It further enables them to be used in timed contests where the only one or a subset of the total number of devices distributed can be programmed to provide an indication that the device is a winner.

Devices of the present invention can be reconfigured in other ways. In the simplest form, the device may actually substitute the new mode of operation for an initial or previously offered mode of operation. For example, in device 10, the nose switch 46 could have been enabled from the beginning and the controller/processor 50 programmed to substitute a different message regarding a contest only if the device was a winning device. Also, existing modes of operation can be disabled, if desired after the end of the preprogrammed time period.

It will be appreciated by those skilled in the art that changes could be made to the embodiments described above without departing from the broad inventive concept thereof. For example, the comparator and the storage register 640 may be in the controller 52 or the stored time value just held in RAM and read in a direct comparison function bit by bit so it does not need to be buffered in a register before comparison. In the later case, the stored time value is an equivalent to the register as is the comparison function in microcontroller 52 to the COMPARATOR 650. It is understood, therefore, that this invention is not limited to the particular embodiments disclosed, but it is intended to cover modifications within the spirit and scope of the present invention as defined by the appended claims.

APPENDIX A

COUNTDOWN TIMER PROGRAM FOR WINBOND
W741C201 4-BIT MICROCONTROLLER

```
;*************************************
                                ;; RAM DEFINE
        TEMP        EQU  00H
        END_FLAG    EQU  01H
        SAVE_ACC    EQU  02H
        PGMREADY    EQU  03H
        PGMDONE     EQU  04H
        DISABLE     EQU  05H
        ENABLE      EQU  06H
        TARGET      EQU  07H
        CLKTEST     EQU  08H
        SECONDS     EQU  09H
        MINUTES     EQU  0AH
        QHOURS      EQU  0BH
        HDAYS            EQU  0CH
        FDAYS            EQU  0DH
        DCLSN            EQU  0EH
        DCMSN            EQU  0FH
        DCHIB            EQU  10H
        LSN         EQU  11H
        MSN         EQU  12H
        HB          EQU  13H
        ZEROS            EQU  14H
        SECCNT      EQU  15H
        MINCNT      EQU  16H
        QHRCNT      EQU  17H
        HDCNT            EQU  18H
        FDCNT            EQU  19H
        TIMERL      EQU  1AH
        TIMERH      EQU  1BH

;*************************************
            ORG  000H
            DIS  INT
            JMP  START
            ORG  004H
            RTN
            ORG  008H
            JMP  TM0_INTERRUPT
            ORG  00CH
            RTN
```

```
;***********************************
            ORG   025H
START:
;W741C201 PORT DEFINITIONS
;PORT RA0 & RA1 are FLAG INPUT
;PORT RA3 N/U, RA.2 for PC yes/no
;PORT RB0 - RB3 are DATA INPUT/OUTPUT
;PORT RC0 - RC3 are PGMREADY, CLKTEST, DISABLE, TRGA control lines

        MOV MR0, #0001b   ;TIMER0 status  TIMER STOPPED & Fosc/1024
        MOV MR1, #0100b
        MOV PM0, #0000b   ; port RA and RB are CMOS
        MOV PM1, #0111b   ;RA.3=out / RA.2= in / RA.1=in / RA.0=in

;if RA2=1 (PC NOT connected) then skip PC download and set default date code

        MOV PM2, #1111b   ;RB0-RB3 DATA INPUT to start
        ;MOV PM3 not used on C201 chip
        MOV PM4, #0000b   ;port RC is output
        ;MOV PM5 not used on C201 chip
        MOV PEF, #0000b   ;port RC does NOT release HOLD or INTERRUPT
;*****************************************
;INTERRUPT DEFINITIONS
        MOV IEF, #00010010b       ;/INT pin and TIMER0 are interrupts
;*****************************************
;HOLD, EVENT AND RELEASE FLAGS

        MOV HEF, #00010010b       ;/INT pin and TIMER0 can release HOLD mode
; read HEF flags and EVF flags
;*****************************************
;REGISTER DEFINITIONS

        MOV TEMP, #0000b          ;clear
        MOV PGMREADY, #0101b ;"READY" to portRC bit0 and DISABLE SPEECH
        MOV PGMDONE, #0110b   ;"DONE" to RC0, CLKTEST to RC1 and DISABLE
SPEECH
        MOV DISABLE, #0100b       ;DISABLE (RC.2)
        MOV ENABLE, #0010B        ;pgm done, enable speech chip, CLKTEST=1
        MOV TARGET, #1000b        ;target date reached RC.3=1
        MOV CLKTEST, #0010b       ;CLKTEST bit high RC.1
        MOV SECONDS, #0000b       ;10 counts of 6 second intervals= 60 sec or 1 minute
        MOV MINUTES, #0000b       ;counts MINUTES up to 15
        MOV QHOURS, #0000b        ;counts QUARTER HOURS, 4QHrs = 1 hour
        MOV HDAYS, #0000b                 ;counts HALF DAYS (12 hour groups)
        MOV FDAYS, #0000b                 ;counts FULL DAYS (2 half day groups)
        MOV DCLSN, #0000b                 ;LSN of DAY COUNT
        MOV DCMSN, #0000b                 ;MSN of DAY COUNT
        MOV DCHIB, #0000B                 ;HIGH bit of DAY COUNT for max of 511 days
```

```
        MOV LSN, #0CH           ;date code default LSN DATA
        MOV MSN, #02H           ;date code default MSN DATA
        MOV HB, #01H            ;date code default HIGH bit for 300 days
        MOV ZEROS, #0000b               ;clear CF
        MOV SECCNT, #1010B      ;max count = 10 six sec intervals
        MOV MINCNT, #1111B      ;15 minutes
        MOV QHRCNT, #0100B      ;4 quarter hours = 1hr
        MOV HDCNT, #1100B               ;12 hours = .5day
        MOV FDCNT, #0010B               ;2x12 = 24hrs
        MOV TIMERL, #0FH                ;timer low nibble
        MOV TIMERH, #0BH                ;timer high nibble, set for 191dec. 6 sec. interval

;*********************************************************************
;PC INTERFACE ROUTINE
;starts only if PC detects READY bit [RC0=1]
;*********************************************************************
        MOV RC, PGMREADY        ;RC=0101b indicates OK to PC ready to accept data
                                ;if PC doesn't detect then ERROR!

PCPROGRAM:
        MOVA TEMP, RA           ;read port A. if RA2=1 keep DEFAULT & jump
        ANL TEMP, #0100B        ;mask out RA2
        JB2 DEFAULT                     ;skip download mode if PC NOT present!

RD_LSN:
        MOVA TEMP, RA           ;read port RA bits 0 and 1
        ORLR TEMP, #1100B               ;set bits
        XRL TEMP, #1110b        ;XOR data with 1110     10 = LSN
        JNZ RD_LSN              ;if ACC=0000, then continue, if not jump back
        MOVA LSN, RB            ;read port RB and store DATE CODE LSN bits

RD_MSN:
        MOVA TEMP, RA           ;read port RA bits 0 and 1
        ORLR TEMP, #1100B               ;set bits
        XRL TEMP, #1101b        ;XOR data with 1101     01 = MSN
        JNZ RD_MSN                      ;if ACC=0000, then continue, if not jump back
        MOVA MSN, RB            ;read port RB and store DATE CODE MSN bits

RD_HB:
        MOVA TEMP, RA           ;read port RA bits 0 and 1
        ORLR TEMP, #1100B               ;set bits
        XRL TEMP, #1100b        ;XOR data with 1100     00 = HB
        JNZ RD_HB               ;if ACC=0000, then continue, if not jump back
        MOVA HB, RB                     ;read port RB and store DATE CODE HB bits

        MOV RC, PGMDONE                 ;RC.0=0, speech still DISABLED
        MOV PM2, #0000B         ;port RB is now OUTPUT!
;******************************
```

```
;DATA READBACK TO PC
;*****************************
OUT_LSN:
        MOVA TEMP, RA           ;read port RA bits 0 and 1
        ORLR TEMP, #1100B               ;set bits
        XRL TEMP, #1110b        ;XOR data with 1110     10 = LSN
        JNZ OUT_LSN                     ;if ACC=0000, then continue, if not jump back
        MOV RB, LSN                     ;OUTPUT LSN DATA

OUT_MSN:
        MOVA TEMP, RA           ;read port RA bits 0 and 1
        ORLR TEMP, #1100B               ;set bits
        XRL TEMP, #1101b        ;XOR data with 1101     01 = MSN
        JNZ OUT_MSN                     ;if ACC=0000, then continue, if not jump back
        MOV RB, MSN                     ;OUTPUT MSN DATA

OUT_HB:
        MOVA TEMP, RA           ;read port RA bits 0 and 1
        ORLR TEMP, #1100B               ;set bits
        XRL TEMP, #1100b        ;XOR data with 1100     00 = HB
        JNZ OUT_HB              ;if ACC=0000, then continue, if not jump back
        MOV RB, HB              ;OUTPUT HB DATA

;if PC detects an error, RESET the timer chip.

        MOV RC, PGMDONE                 ;done flag to PC, RC=0110b
        MOV RC, ENABLE          ; RC=0010b
        MOV END_FLAG, #0000B
        JMP CLOCKER             ;start counting

DEFAULT:
        MOV PM2, #0000B         ;port RB is now OUTPUT!
        MOV CLKTEST, #0011B     ;sets PGMREADY=1 for reprogram
        MOV RC, CLKTEST
        MOV END_FLAG, #0001B
        JMP CLOCKER


;*********************************************************************
;COUNTDOWN TIMER MAIN PROGRAM
;*********************************************************************
CLOCKER:
        DIS INT
        CLR EVF, #00010111b
        MOV TM0L, TIMERL        ;timer =191 , 6sec theoretical @ Fclk=32Hz
        MOV TM0H, TIMERH
        MOV MR0, #1001b         ;START TIMER0
        MOV HEF, #00010010b     ;/INT pin and TIMER0 can release HOLD mode
```

```
        MOV IEF, #00010010b      ;/INT pin and TIMER0 are interrupts
        EN INT

HOLD

TM0_INTERRUPT:
        MOV TM0L, TIMERL         ;timer =191 , 6sec theoretical @ Fclk=32Hz
        MOV TM0H, TIMERH
        MOV MR0, #1001b          ;START TIMER0
        EN INT
        XRLR CLKTEST, #0010b     ;toggle bit 1 for CLOCK TEST PIN
        MOV RC, CLKTEST
        MOV RB, ZEROS            ;clear RB

SEC:
        INC SECONDS              ;SEC=SEC+1 every 6 seconds for 10 times
        ;MOV RB, SECONDS         ;output seconds count
*****************TESTING*************
        XRL SECCNT, ACC          ;if SECONDS=10
        JZ MIN                   ;then count minutes
        JMP COMPARE              ; keep counting if SECONDS <10

MIN:
        MOV SECONDS, #0000b      ;reset seconds counter
        INC MINUTES              ;a minute has passed
        XRL MINCNT, ACC
        JZ QHOUR
        JMP COMPARE              ;keep counting if t< 15minutes

QHOUR:
        MOV MINUTES, #0000b      ;reset 15 minute counter
        INC QHOURS               ;a quarter hour has passed
        XRL QHRCNT, ACC
        JZ HDAY
        JMP COMPARE

HDAY:
        MOV QHOURS, #0000b       ;reset quarter hour counter
        INC HDAYS          ;if here then an HOUR has passed
        XRL HDCNT, ACC
        JZ FDAY
        JMP COMPARE

FDAY:
        MOV HDAYS, #0000b        ;reset hour counter
        INC FDAYS          ;if here then a HALF DAY has passed
        XRL FDCNT, ACC
```

```
        JZ DAYZ
        JMP COMPARE

DAYZ:
        CLR CF                  ;need to clear CF?
        MOV FDAYS, #0000b       ;reset half day counter
        MOV TEMP, #0000B
        INC DCLSN       ;inc.LSN of day counter, CF may go high if overflow
        ADCR TEMP, #0000B       ;if CF=1, TEMP=0001b, ACC=TEMP
        CLR CF
        ADDR DCMSN, ACC                 ;if ACC=0001, then DCMSN is incremented
        JNC COMPARE
        INC DCHIB       ;increment High Bit if CF=1
        CLR CF                  ;clear CF

;compare 3-nibble data with stored date-code in MAIN program

COMPARE:
        MOV ACC, HB                     ;compare HIGH bit
        XRL DCHIB, ACC
        JZ MSN_COMP
        JMP WAIT                ;continue counting if not equal

        MSN_COMP:
                MOV ACC, MSN    ;read in MSN of DATE CODE DATA
                XRL DCMSN, ACC
                JZ LSN_COMP
                JMP WAIT        ;compare MSN of DAY COUNT to DATA
        LSN_COMP:
                MOV ACC, LSN    ;read in LSN of DATE CODE DATA
                XRL DCLSN, ACC
                JZ SURPRISE     ; if everything matches, then TARGET
                JMP WAIT        ;continue counting if not equal

        WAIT:                   ;data readback routine
                ANLR CLKTEST, #1110B    ;clears RC0 if =1
                MOV RC, CLKTEST
                MOV RB, ZEROS
                MOV RB, MINUTES
                XRLR CLKTEST, #0001B    ;toggles RC0 HIGH
                MOV RC, CLKTEST
                ANLR CLKTEST, #1110B    ;sets RC0 to 0
                MOV RC, CLKTEST
                NOP
                NOP
                MOV RB, QHOURS
                XRLR CLKTEST, #0001B    ;toggles RC0 HIGH
                MOV RC, CLKTEST
```

```
ANLR CLKTEST, #1110B   ;sets RC0 to 0
MOV RC, CLKTEST
NOP
NOP
MOV RB, HDAYS
XRLR CLKTEST, #0001B   ;toggles RC0 HIGH
MOV RC, CLKTEST
ANLR CLKTEST, #1110B   ;sets RC0 to 0
MOV RC, CLKTEST
NOP
NOP
MOV RB, FDAYS
XRLR CLKTEST, #0001B   ;toggles RC0 HIGH
MOV RC, CLKTEST
ANLR CLKTEST, #1110B   ;sets RC0 to 0
MOV RC, CLKTEST
NOP
NOP
MOV RB, DCLSN
XRLR CLKTEST, #0001B   ;toggles RC0 HIGH
MOV RC, CLKTEST
ANLR CLKTEST, #1110B   ;sets RC0 to 0
MOV RC, CLKTEST
NOP
NOP
MOV RB, DCMSN
XRLR CLKTEST, #0001B   ;toggles RC0 HIGH
MOV RC, CLKTEST
ANLR CLKTEST, #1110B   ;sets RC0 to 0
MOV RC, CLKTEST
NOP
NOP
MOV RB, DCHIB
XRLR CLKTEST, #0001B   ;toggles RC0 HIGH
MOV RC, CLKTEST
ANLR CLKTEST, #1110B   ;sets RC0 to 0
MOV RC, CLKTEST
NOP
NOP
MOV ACC, END_FLAG
XRLR CLKTEST, ACC      ;sets RC0 back to what it was
MOV RC, CLKTEST
MOV ACC, ZEROS         ; clear ACC
MOV RB, ZEROS          ;clear port RB

RTN                    ;hold mode until interrupt
```

```
SURPRISE:
        MOV RC, TARGET          ;trigger code to speech processor chip
                                ;new speech is enabled.
        DIS INT
        STOP
END
```

We claim:

1. An electronic amusement device comprising:

a housing having an outer side presented to a consumer using the device;

an electronic timer in the housing configured to track time to an end of an extended time period having a length of at least a plurality of weeks, the extended time period being preset in the device and the timer started before the device is released to the consumer, the timer further being configured to output a signal at the end of the extended period; and a controller in the housing configured to perform at least one task in at least an initial mode of operation available to the consumer using the device, the controller being operably coupled with the timer and responsive to the signal from the timer to enable, for a first time, performance of at least one new additional task the controller did not perform before receipt of the timer signal.

2. The amusement device according to claim 1 wherein the timer has capacity to track an extended period of at least a month.

3. The amusement device according to claim 1 wherein the timer has capacity to track an extended period of at least a plurality of months.

4. The amusement device according to claim 1 wherein the timer has capacity to track an extended period of at least a year.

5. The amusement device according to claim 1 wherein the timer has capacity to track an extended period of at least a plurality of years.

6. The amusement device according to claim 1 further comprising:

at least one source of sound, light or movement of at least part of the device operably coupled with the controller in the housing; and wherein the controller is configured to provide at least an initial mode of operation of the source before output of the timer signal and to change the initial mode of operation of the source in response to the timer signal.

7. The amusement device according to claim 1 wherein the timer comprises:

a first stored value representative of the time period to be tracked;

a crystal oscillator;

a second stored value updated regularly by the crystal oscillator; and a comparator configured to compare the second stored value with the first stored value and to output the timer signal after the values are equal.

8. The amusement device according to claim 7 wherein the timer includes a register containing the first stored value and a signal connector coupled with the register to load the first stored value into the register from outside the timer.

9. The amusement device according to claim 8 wherein the signal connector extends outside the housing.

10. The amusement device according to claim 8 in combination with a package containing the device wherein the signal connector is accessible from the outside of the package without opening the package.

11. The amusement device according to claim 9 wherein the timer further includes a plurality of registers coupled together serially with one another and with the crystal oscillator such that each register incrementally advances the next register in the series.

12. The amusement device according to claim 11 wherein the timer further includes a time period register and wherein the plurality of registers coupled together output one bit per day to the time period register.

13. The amusement device according to claim 12 wherein the time period register has sufficient bit places to store a time period of at least fifteen days.

14. The amusement device according to claim 1 wherein the controller is enabled by the timer signal to announce whether the device is a prize winning device in a contest.

15. The amusement device according to claim 1 wherein the timer is configured to output a second signal after a second extended period following the extended period and wherein the controller is configured to perform at least one new additional task the controller did not perform before receipt of the second signal from the timer.

16. An electronic amusement device comprising:

a housing having an outer side presented to a consumer using the device;

a controller in the housing configured to provide at least one initial mode of operation of at least part of the device for the consumer; and an electronic timer in the housing operably coupled with the controller, the timer being configured to track time to an end of an extended time period, the period being of a length of at least a plurality of weeks, the extended time period being preset in the device and the timer being started before the device is released to the consumer, the timer further being configured to output a signal to the controller at the end of the extended period;

wherein the controller is configured to respond to the signal from the timer to provide for a first time, a new mode of operation different from all of the initial modes of operation provided by the controller before receipt of the timer signal by the controller.

17. An electronic amusement device comprising:

a housing having an outer side presented to a consumer using the device;

a controller in the housing configured to provide at least one initial mode of operation of at least part of the device for the consumer; and an electronic timer in the housing operably coupled with the controller, the timer being configured to track time to an end of an extended time period, the period being of a length of at least a plurality of weeks, the extended time period being preset in the device and the timer being started before the device is released to the consumer, the timer further being configured to output a signal to the controller at the end of the extended period;

wherein the controller is configured to respond to the signal from the timer to disable for a first time, at least one of the initial modes of operation provided by the controller before receipt of the timer signal by the controller.

18. An electronic amusement device comprising:

a housing having an outer side presented to a consumer using the device;

a controller in the housing configured to provide at least one initial mode of operation of at least part of the device for the consumer; and an electronic timer in the housing operably coupled with the controller, the timer being configured to track time to an end of an extended time period, the period being of a length of at least a plurality of weeks, the extended time period being preset in the device and the timer being started before the device is released to the consumer, the timer further being configured to output a signal to the controller at the end of the extended period;

wherein the controller is configured to respond to the signal from the timer to change for a first time, at least the one initial mode of operation to a different mode of operation.

19. The amusement device according to claim 14 wherein the controller provides a plurality of initial modes of operation of the device to the consumer and wherein at least one of the initial modes of operation is changed in response to the signal from the timer.

20. The amusement device according to claim 15 wherein less than all of the plurality of initial modes of operation are changed by the controller in response to the signal from the timer.

* * * * *